US006116533A

United States Patent [19]

Elder

[11] Patent Number: 6,116,533

[45] Date of Patent: Sep. 12, 2000

[54] WIRE DISPENSING DEVICE

[76] Inventor: Doyle Elder, P.O. Box 278, Arapaho, Okla. 73620

[21] Appl. No.: 09/296,419

[22] Filed: Apr. 23, 1999

[51] Int. Cl.[7] ..... B65H 16/02

[52] U.S. Cl. ..... 242/594.4; 242/594.6; 242/557; 242/598.2; 242/598.3; 242/588; 280/79.6; 280/47.35

[58] Field of Search ..... 242/594.4, 594.3, 242/594.5, 594.6, 557, 598.2, 598.3, 588; 280/79.11, 79.3, 79.6, 47.34, 47.35, 47.371; 211/85.5, 44, 45

[56] References Cited

U.S. PATENT DOCUMENTS

| | | | |
|---|---|---|---|
| 511,639 | 12/1893 | McKinne | 242/594.6 |
| 1,581,352 | 4/1926 | Kuen | 280/79.3 X |
| 2,536,027 | 1/1951 | Braswell | 242/594.4 |
| 2,957,644 | 10/1960 | Beardslee | 242/594.6 |
| 3,400,828 | 9/1968 | May | 280/79.6 X |
| 3,910,519 | 10/1975 | Martinez | 242/598.3 X |
| 4,383,398 | 5/1983 | Tipton | 242/594.5 X |
| 4,533,091 | 8/1985 | Knight et al. | 242/598.2 X |
| 4,564,152 | 1/1986 | Herriage | 242/594.4 X |
| 4,605,237 | 8/1986 | Torgrimson . | |
| 5,188,308 | 2/1993 | Tussing . | |
| 5,285,981 | 2/1994 | Pavelka . | |
| 5,316,232 | 5/1994 | Lambert, Jr. . | |
| 5,397,209 | 3/1995 | Heim | 280/79.6 X |

FOREIGN PATENT DOCUMENTS

| | | | |
|---|---|---|---|
| 1333340 | 10/1973 | United Kingdom | 280/79.6 |

*Primary Examiner*—Donald P. Walsh
*Assistant Examiner*—Minh-Chau Pham
*Attorney, Agent, or Firm*—Siemens Patents Services

[57] ABSTRACT

A wheeled dispenser for dispensing wire from spools. The dispenser has a rectangular frame, three stationary vertical posts, and two rotatable vertical posts each located between two stationary posts. Each rotatable post has a plurality of laterally projecting rods for supporting spools. The rotatable post can be rotated to a first position such that the rods are accessible for loading spools, and rotated to a second position wherein each rod can latch to an adjacent stationary post, with the spools held parallel so that they all pay out wire in one direction. The dispenser has wheels and a handle which can incline relative to the frame. A pin arranged to close a clevis secures the handle in a substantially upright position relative to the frame. The frame has upright stanchions bearing receptacles disposed to enable bars to span two stanchions and be held in the receptacles in a horizontal position, so that additional spools can be carried. The frame has holders for storing the bars beneath the frame when they are not mounted on the stanchions.

12 Claims, 3 Drawing Sheets

WIRE DISPENSING DEVICE

BACKGROUND OF THE INVENTION

1. Field of the Invention

The present invention relates to a carriage for carrying spools of wire and other elongate stock materials, for the purpose of dispensing the elongate materials. The carriage is employed wherever it is desired to dispense generally similar reeled materials which may differ in certain aspects, such as dimensions, color, minor internal or external construction, and the like. A preferred application of the invention is in electrical construction, wherein an electrician may require many spools each having different types of electrical wires or cables. However, the invention is equally applicable to dispensing of ribbons, filaments, and other material in industrial, commercial and other settings.

2. Description of the Prior Art

Construction electricians must typically have at hand many different types of electrical cables for completing a construction project. These types of cables may differ in many aspects. For example, different wire gauges are typically employed throughout a building. In large commercial, institutional, and industrial projects served by multiphase electrical supply systems, the various phases and neutral conductors are usually distinguished by color coding of the insulating jacket. Some applications require stranded conductors, while others require solid, single filament conductors. Therefore, a wide variety of electrical cables are typically required in each construction project.

It is preferred to work with spools of significant length of cable to avoid frequent depletion of a spool. Illustratively, many electricians prefer to work with spools containing 2,500 feet of cable. As wire gauge increases, the various spools become correspondingly heavy. It would be impractical to carry individual spools of wire from place to place within a construction site.

The prior art has proposed carriages adapted to carry spools of wire and to make dispensing easy and practical. An example is seen in U.S. Pat. No. 5,188,308, issued to Norman P. Tussing on Feb. 23, 1993, describes a wire cart adapted to store a plurality of wire spools. The cart has a plurality of vertical posts from which branches project laterally. The spools are supported on the branches. In the device of Tussing, the posts are fixed in position on the cart. By contrast, in the present invention, the posts rotate on the cart between a first position enabling easy loading of a spool onto a branch and a second position wherein wire is paid out in the same direction from which the spools are loaded. The supporting branches or rods of the present invention latch into place in the second position.

U.S. Pat. No. 5,316,232, issued to John A. Lambert, Jr., on May 31, 1994, describes a wire dispensing cart which carries spools of wire. The spools are supported on fixed horizontal rods. By contrast, in the present invention, comparable rods rotate to the first position to enable easy loading of spools onto the rods. The rods in the present invention are then rotated into the second position, from which wire is paid out. The support rods latch into place in the second position.

A wire dispenser seen in U. S. Pat. No. 5,285,981, issued to Steven M. Pavelka on Feb. 15, 1994, supports spools in one position. The device of Pavelka lacks ability to shift between first and second positions and to latch in one of the positions, as seen in the present invention.

U.S. Pat. No. 4,605,237, issued to Donald L. Torgrimson on Aug. 12, 1986, describes a two wheeled wire dispensing carriage wherein spools are supported between the two wheels, which are quite large. The rods supporting the spools are fixed in position generally parallel to the axle. Torgrimson's device lacks the ability to shift between first and second positions, and to latch in one of the positions.

None of the above inventions and patents, taken either singly or in combination, is seen to describe the instant invention as claimed.

SUMMARY OF THE INVENTION

The present invention provides a wire dispensing wheeled carriage which enables spools to be readily loaded onto supporting rods, and orients the spools so that they pay out in one common direction. The carriage has a wheeled frame having a handle, so that it is readily maneuvered through a building under construction. Three fixed or stationary posts project upwardly from the frame. Two spool supporting posts are disposed between each two adjacent fixed posts. The spool supporting posts have laterally projecting rods onto which spools are loaded. The spool supporting posts are rotatably mounted on the frame. The spool supporting posts rotate from the position in which spools are loaded to a second position wherein the rods latch to the fixed posts for stability. The second position is that wherein the posts have been rotated or displaced ninety degrees from the first position. Wire is paid out with the spool supporting posts in the second position.

This arrangement enables each rod to be loaded from the right or left side of the carriage. After the spool supporting posts are rotated and latched into the second position, wire can be paid out to the right or left side from many spools.

The frame has two upright stanchions at the right side and two upright stanchions at the left side, for holding additional spools. Each stanchion terminates in a receptacle which removably receives a rod. A rod can be loaded with spools and placed so as to span two stanchions. The stanchions are lower in height than the location of the rods projecting from the spool supporting posts, so that all spools carried on the rods can pay out wire in the same direction as those of the spool supporting posts without interfering with the latter. The rods are stored beneath the frame when not in use as auxiliary supports for spools.

Accordingly, it is one object of the invention to provide a wire dispenser suitable for carrying and dispensing wire from spools.

It is another object of the invention that the spools be readily loaded onto vertical posts from one direction and be oriented to pay out wire in the same direction.

It is a further object of the invention to provide rotatable posts which are loaded with spools in one position and which rotate to a second position displaced ninety degrees from the first position.

Yet another object of the invention is that the rotatable posts latch to fixed posts in the second position.

Still another object of the invention is to provide wheels and handle to the wire dispenser, so that it functions as a cart.

An additional object of the invention is to provide auxiliary spool carrying apparatus on the wire dispenser.

It is a further object of the invention that the auxiliary spool carrying apparatus be readily assembled to and disassembled from the cart.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
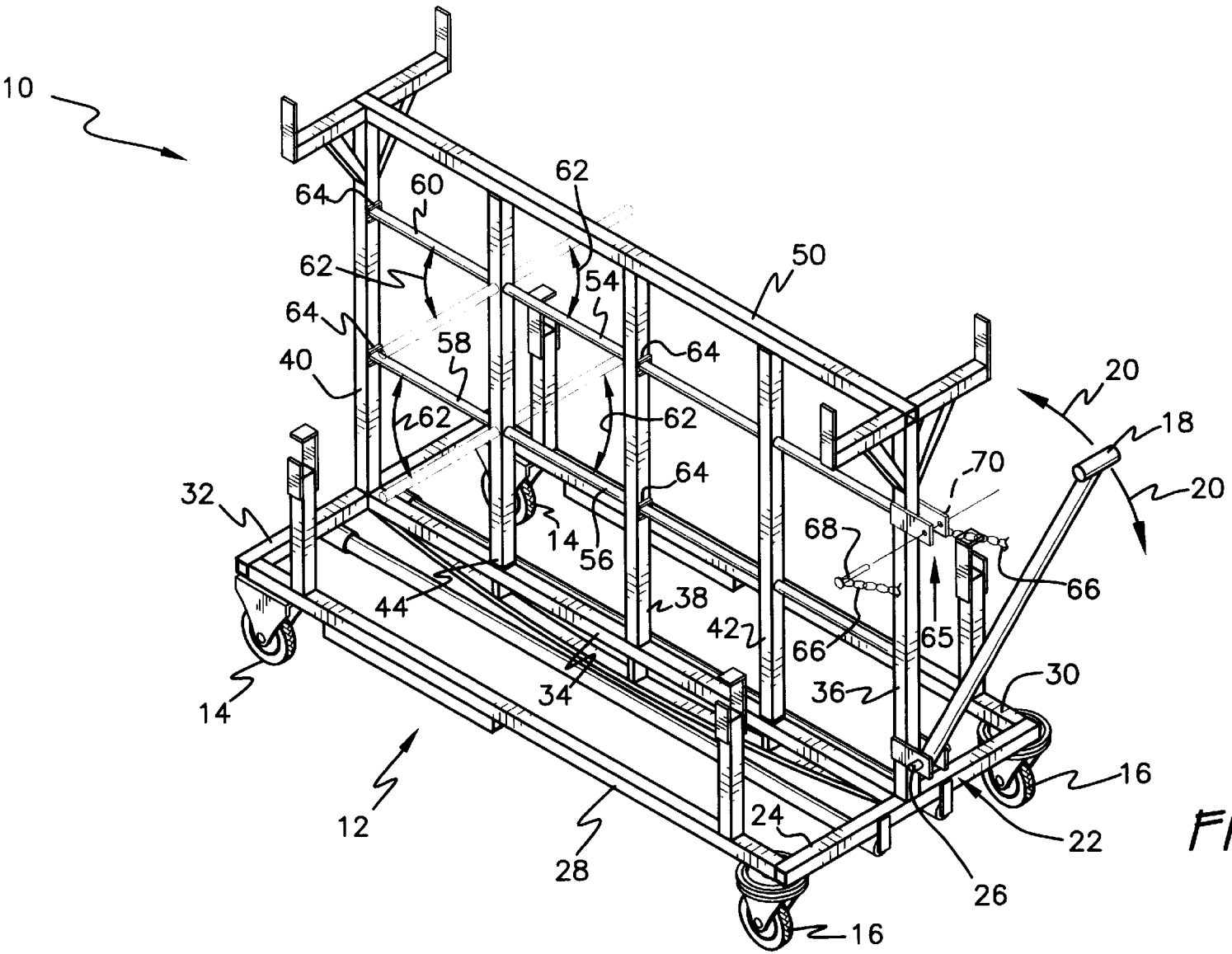
FIG. 1 is a perspective partial view of the invention, with some components omitted and broken away for clarity.

FIG. 1 of the drawings shows a preferred embodiment of the invention wherein dispenser 10 is a wheeled carriage or cart capable of being rolled over and maneuvered along a floor (not shown) or other flat environmental surface. Dispenser 10 dispenses elongate stock material from spools (see FIG. 3). Dispenser 10 comprises a square or rectangular frame 12 bearing fixed wheels 14 and steerably rotatable wheels 16.

A handle 18 is pivotally attached to frame 12 such that handle 18 can be maneuvered by the user to assume different angles relative to a horizontal direction. It will be assumed that dispenser 10 is horizontally oriented in normal use as it is drawn over a floor such that the plane of generally planar frame 12 is parallel to the floor. Attachment of handle 18 to frame 12 may be accomplished employing a suitable pivoting connector enabling inclination of handle 18 as indicated by arrows 20. Illustratively, the base of handle 18 may be entrapped within a clevis 22 fixed to the forward frame member 24, supported on a pin 26 or the like.

Frame 12 comprises five principal structural members, one of which is member 24. Arbitrarily characterizing forward frame member 24 as the front side of dispenser 10, the remaining structural members are right side channel 28, left side channel 30, rear frame member 32, and central frame member 34. Central member 34 is preferably located along the longitudinal axis of frame 12 to assist in maintaining balance of dispenser 10 in both loaded and unloaded conditions. The structural frame members are fabricated from any suitable rigid stock material, such as square steel tubing.

Three fixed or stationary posts 36, 38, 40 are fixed to and project vertically upwardly from frame 12. Two spool supporting posts 42, 44 are rotatably mounted on frame 12. Each spool supporting post 42 or 44 is located between adjacent fixed posts 36, 38 or 38, 40, respectively. A representative way of supporting posts 42, 44 is shown in detail in FIG. 2. Posts 42, 44 have pegs (shown representatively as 46) projecting at either end. Peg 46 is received in a bore 48 extending entirely through frame member 34 at the lower end of post 42 or 44. The arrangement of bore 48 and peg 46 forms a rotatable mounting both enabling its associated post 42 or 44 to rotate about its associated axis 52 such that axis 52 is constrained to remain in a fixed position relative to frame 12.

A structural member 50 (see FIG. 1) spans and is secured to posts 36, 38, 40 at the top thereof. Spool supporting posts 42, 44 are rotatably fixed to member 50 in a manner similar to that by which they are mounted on central frame member 34, although the mounting arrangement at member 50 is a mirror image of the mounting arrangement at member 34. It will become apparent that posts 42, 44 can then rotate freely about their vertically oriented longitudinal axes 52.

Returning to FIG. 1, spool supporting post 44 has four rods 54, 56, 58, 60 solidly fixed to and projecting laterally therefrom. Each rod 54, 56, 58, or 60 is connected to its associated spool support post 44 at one end and has a second free end. Post 42 is similarly configured and functions similarly as post 44, although full illustration of post 42 is broken away for clarity of FIG. 1. Rods 54, 56, 58, 60 are dimensioned and configured to abut adjacent fixed posts 38, 40 in the position indicated by solid lines. Post 44 can be rotated ninety degrees, as indicated by arrows 62, so that rods 54, 56, 58, 60 come to project to the right and left sides of dispenser 10. Spools (shown in the dispensing position in FIG. 3) are loaded onto rods 54, 56, 58, 60 in the position indicated in broken lines in FIG. 1.

Figure 4:
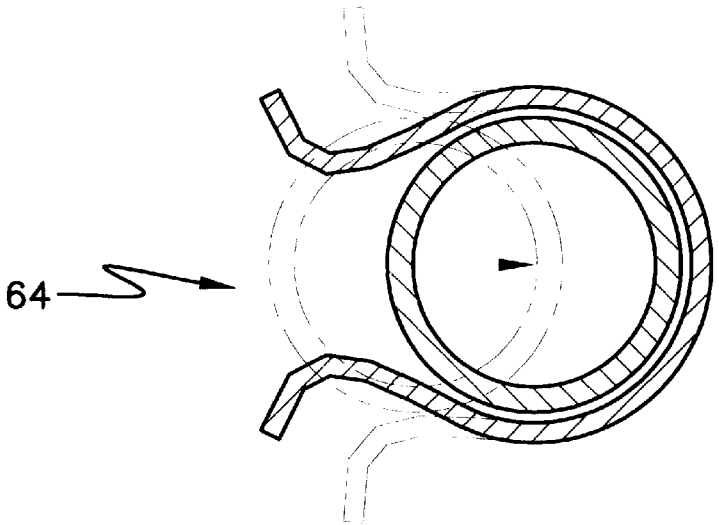
FIG. 4 is a detail view of a component of FIGS. 1 and 3.

After loading spools, post 44 is rotated until rods 54, 56, 58, 60 come to abut posts 38, 40. Rods 54, 56, 58, 60 are received in latches 64. Each latch 64 is of any suitable well known type. A representative latch 64 is shown in FIG. 4.

Again referring to FIG. 1, handle 18 is retained in a substantially upright position relative to post 36 by a chain 66 and a pin 68. The upright position need not necessarily be vertical. It is merely desired that handle 18 not incline forwardly to a degree which would unduly interfere with environmental objects and intrude upon work space. Handle 18 is received in a clevis 65 and retained by a pin 68 which is passed through bores 70 formed in clevis 65.

Figure 3:
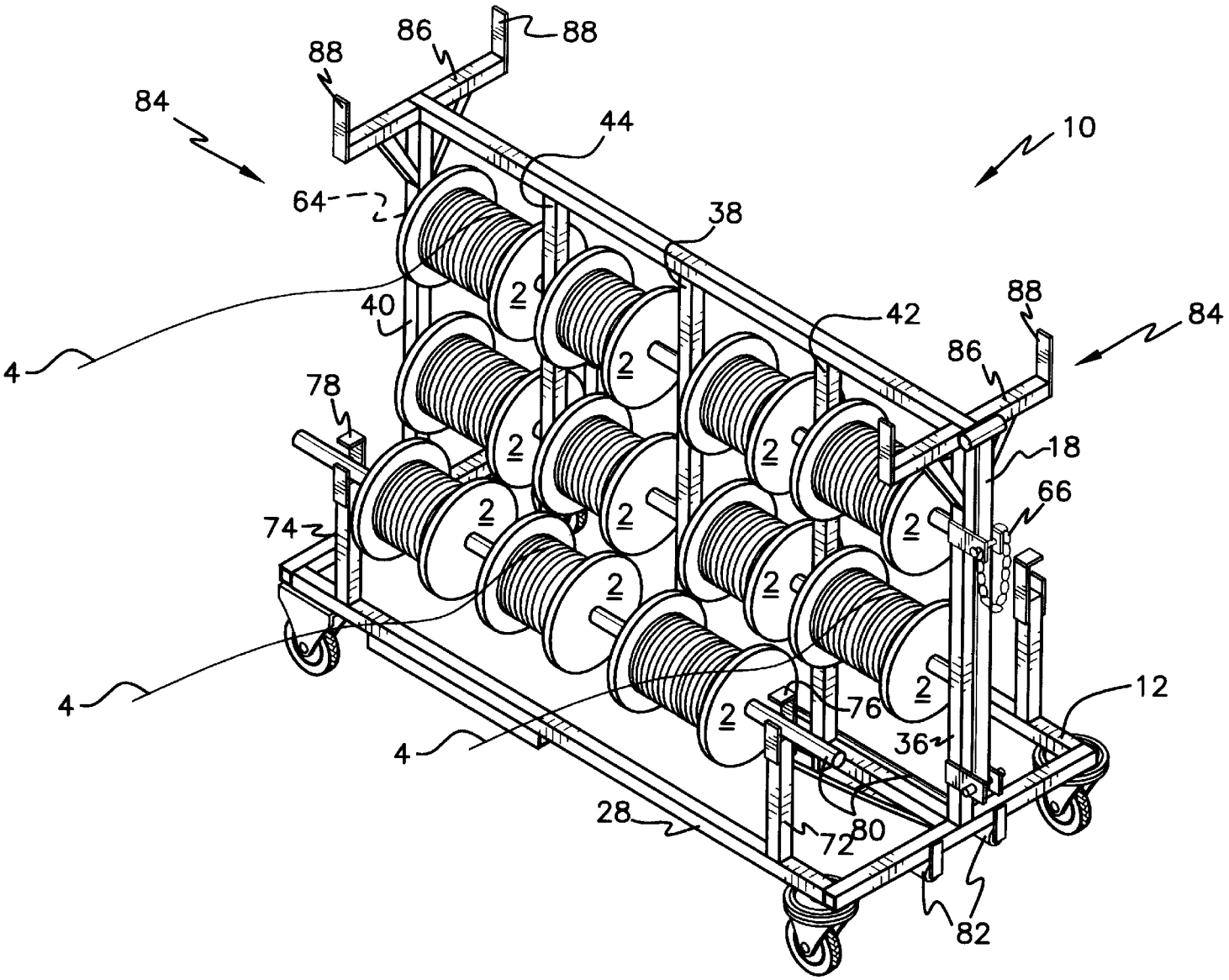
FIG. 3 is an environmental, perspective view of the invention.

FIG. 3 illustrates dispenser 10 in a condition loaded with spools 2. It will be seen that spools 2 may be arranged to pay out wire 4 in one direction, thereby facilitating the task of an electrician who may select among the available types of wire 4 while standing in one place at the right or left side of dispenser 10.

Also shown in FIG. 3 is an optional auxiliary arrangement which increases the number of spools 2 which may be made available for dispensing wire 2. Two low stanchions 72, 74 project upwardly from frame member 28. Each low stanchion 72 or 74 terminates at its upper end at a receptacle 76 or 78 dimensioned and configured to retain a bar 80 which may be manually placed into receptacles 76, 78. Receptacles 76, 78 partially surround or entrap bar 80, which is retained by gravity. Receptacles 76, 78 have an opening enabling manual insertion and withdrawal of bar 80. Bar 80 may be loaded with one or more spools 2 prior to being mounted in its operable location supported on low stanchions 72, 74. Stanchions 72, 74 are low in that when bar 80 is loaded with spools 2 and mounted in its operable location, it will not interfere with access to wires 4 being paid out from spools 2 supported on posts 42, 44.

Bar 80 is stored beneath frame 12 when not received within receptacles 76, 78. This is accomplished by providing holders in the form of sockets or clips 82 attached to and located beneath frame 12. The arrangement of stanchions 72, 74, bar 80, and clips 82 is repeated in mirror image fashion on the left side of dispenser 10 so that additional wire 4 may be paid out from the left side of dispenser 10 if desired.

Dispenser 10 can be employed to carry elongate materials such as lumber and electrical conduit and tubing in addition to carrying spools 2. These additional materials may be carried on frame 12, spanning members 24 and 32 to the right and left of posts 36, 38, 40, 42, 44. Stanchions 72, 74 perform a second function in serving as stops retaining materials on frame 12, preventing such materials from sliding and rolling off frame 12. Still additional elongate objects may be carried on upwardly open carriers 84 which are fixed to the upper ends of posts 36, 40. Illustratively, lumber carried on open carriers 84 could be employed as shelves. Carriers 84 have horizontally oriented lateral members 86 and upwardly projecting stops 88 which prevent carried materials from rolling and sliding off members 86 to the right and left.

The present invention is susceptible to variations and modifications which may be introduced without departing from the inventive concept. Some variations (not shown) will be described. For example, frame 12 may be fabricated from circular, square, rectangular, or L-shaped stock metallic channel, lumber, or other suitable materials. Wheels 14, 16 may be arranged with or without caster. If desired, all wheels 14, 16 may be rotatably mounted to frame 12, or none may be rotatably mounted. Latches 64 may comprise resilient clips or still other arrangements suitable for releasably retaining rods 54, 56, 58, 60. Similarly, receptacles 76, 78 of stanchions 72, 74 may take other configurations, or be replaced by clips, latches, and other apparatus which can releasably hold bar 80.

In further examples, dispenser 10 need not be configured to be bilaterally symmetrical, although this is a preferred configuration. Similarly, the various fixed and rotatable posts can be arranged to pay out wire in directions other than to the right and left, although this arrangement is deemed most efficient from the standpoint of maximizing the number of spools which are accessible along the length of dispenser 10. Of course, locations of the handle and of fixed and rotatable wheels could be changed so that the resultant dispenser would be wider than it is long, if it were desired to pay out wire to the front and rear sides.

Figure 2:
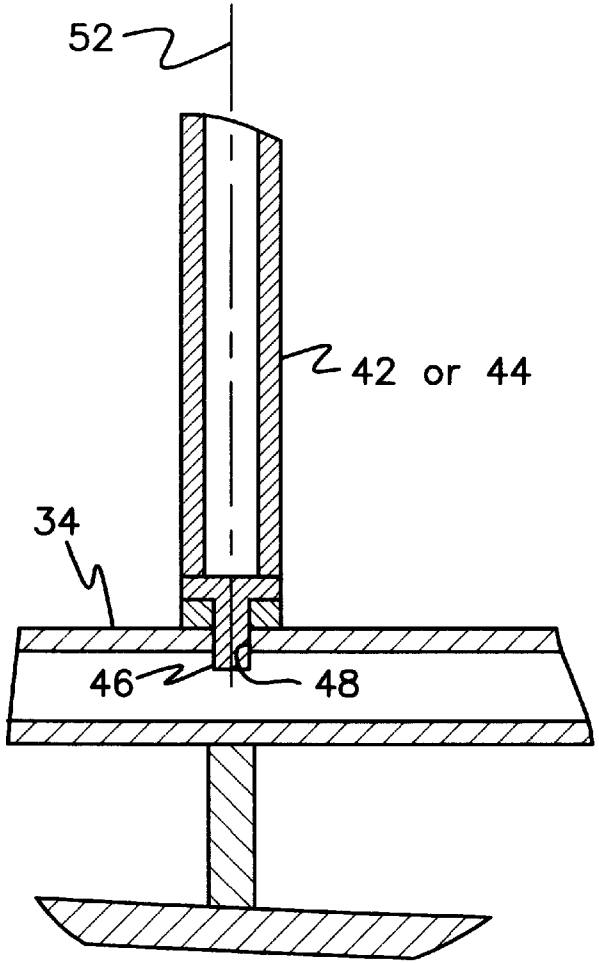
FIG. 2 is a side cross sectional detail view taken from FIG. 1.

The embodiment of FIGS. 1 and 2 enables rods 54, 56, 58, 60 to be rotatably mounted relative to frame 12 in that they are fixed to a common element (i.e., post 40) which itself is rotatably mounted on frame 12. In a variation of this arrangement, posts 42, 44 could be fixed to frame 12, with rods 54, 56, 58, 60 being rotatably mounted on posts 42, 44, although the arrangement of FIGS. 1 and 2 is preferred for economy of manufacture. Rotatable mountings, where employed, could incorporate bearings and other swiveling mechanisms.

It is to be understood that the present invention is not limited to the embodiments described above, but encompasses any and all embodiments within the scope of the following claims.

What is claimed is:

1. A dispenser for dispensing elongate stock material from spools, comprising a frame;

a fixed post solidly fixed to said frame and projecting upwardly from said frame;

a spool support post rotatably mounted on said frame and projecting upwardly from said frame, wherein at least one said spool support post has a vertically oriented longitudinal axis and at least one rod projecting laterally from said spool support post such that each said rod is connected to one spool support post at one end and has a second free end, and a rotatable mounting disposed to rotatable mount each said spool support post about its longitudinal axis on said frame and to constrain said longitudinal axis of said spool support post to remain in a fixed position relative to said fixed post and to said frame.

2. The dispenser according to claim 1, wherein said frame has a plurality of wheels depending therefrom, whereby said dispenser can be rolled across a flat environmental surface.

3. The dispenser according to claim 2, wherein said frame has a handle and a pivoting connector disposed to attach said handle pivotally to said frame such that said handle selectively assumes different angles relative to a horizontal direction when said frame is horizontally oriented.

4. The dispenser according to claim 3, further comprising a clevis and a removable pin engageable with said clevis, said clevis and said pin disposed to retain said handle in a substantially upright position relative to a said post.

5. The dispenser according to claim 1, further comprising holders disposed to releasably hold one said rod to one said fixed post.

6. The dispenser according to claim 1, wherein said frame is rectangular and has a front side, a right side, a left side, and a rear side, wherein each said fixed post and each said spool support post are disposed between said right side and said left side, and wherein said dispenser further comprises two low stanchions projecting from said frame, each said low stanchion having a receptacle disposed atop said low stanchion, and said dispenser further comprising a bar dimensioned and configured to be manually removably received in each said receptacle of each said low stanchion, and retainers disposed to retain said bar on said frame when said bar is not received within said receptacles of said low stanchions.

7. The dispenser according to claim 1, wherein said dispenser includes at least two said fixed posts each having and upper end and an upwardly open carrier fixed thereto at said upper end.

8. A dispenser for dispensing elongate stock material from spools, comprising a rectangular frame having a forward side, a right side, a left side, and a rear side, a plurality of wheels depending therefrom, whereby said dispenser can be rolled across a floor, at least two fixed posts solidly fixed to said frame and projecting upwardly from said frame, two of said fixed posts each having an upper end and an upwardly open carrier fixed thereto at said upper end, and a handle and a swivelling connector disposed to attach said handle pivotally to said frame such that said handle selectively assumes different angles relative to a horizontal direction when said frame is horizontally oriented, and a clevis and a removable pin engageable with said clevis, said clevis and said pin disposed to retain said handle in a substantially upright position relative to a said post; and at least one spool support post rotatably mounted on said frame between said fixed posts and projecting upwardly from said frame, wherein at least one said spool support post has at least one rod projecting laterally therefrom, and means for rotatably mounting each said spool support post on said frame, wherein each said fixed post has a holder disposed to releasably hold each said rod to one said fixed post, wherein each said fixed post and each said spool support post are disposed between said right side and said left side, and wherein said dispenser further comprises two low stanchions projecting from said frame, each said low stanchion having a receptacle disposed atop said low stanchion, said dispenser further comprising a bar dimensioned and configured to be manually removably received in each said receptacle of each said low stanchion, and retainers disposed to retain said bar on said frame when said bar is not received within said receptacles of said low stanchions.

9. A dispenser for dispensing elongate stock material from spools, comprising a horizontal frame having a longitudinal axis and a central member located along said longitudinal axis of said frame, and a plurality of posts supported on said central member and projecting upwardly therefrom, wherein at least one said post has a plurality of rods projecting laterally on opposed sides of said post and projecting horizontally therefrom such that each said rod is connected to said at least one said post at one end and has a second free end, said frame has a plurality of wheels depending therefrom, whereby said dispenser can be rolled across a flat environmental surface, and at least two of said posts each have an upper end and an upwardly open carrier fixed thereto at said upper end;

said dispenser further comprising two low stanchions projecting from said frame, each said low stanchion having a receptacle disposed atop said low stanchion, and said dispenser further comprising a bar dimensioned and configured to be manually removably received in each said receptacle of each said low stanchion, and retainers disposed to retain said bar on said frame when said bar is not received within said receptacles of said low stanchions.

10. The dispenser according to claim 9, wherein said frame has a handle and a pivoting connector disposed to attach said handle pivotally to said frame such that said handle selectively assumes different angles relative to a horizontal direction when said frame is horizontally oriented.

11. The dispenser according to claim 10, further comprising a clevis and a removable pin engageable with said clevis, said clevis and said pin disposed to retain said handle in a substantially upright position relative to said at least one said post.

12. A combined wire dispenser and material hauling carriage for carrying spools of wire and other stock materials, comprising a horizontal frame having a longitudinal axis and a central member located along said longitudinal axis of said frame, and a plurality of posts supported on said central member and projecting upwardly therefrom, wherein at least one said post has a plurality of rods projecting laterally on opposed sides of said at least one said post and projecting horizontally therefrom such that each said rod is connected to said at least one said post at one end and has a second free end, said frame has a plurality of wheels depending therefrom, whereby said combined wire dispenser and material hauling carriage can be rolled across a flat environmental surface, and at least two of said posts each have an upper end and an upwardly open carrier fixed thereto at said upper end, wherein lumber can be placed in and span said upwardly open carriers.

* * * * *